US009607471B2

(12) United States Patent
Thacker et al.

(10) Patent No.: US 9,607,471 B2
(45) Date of Patent: Mar. 28, 2017

(54) GAMING SYSTEMS AND METHODS FOR USE IN PROVIDING RANDOM REWARDS ASSOCIATED WITH PLAY-FOR-FUN APPLICATIONS

(75) Inventors: Christopher John Thacker, Earlysville, VA (US); Daniel William Milligan, Palmyra, VA (US); Ryan Cuddy, Reno, NV (US)

(73) Assignee: Video Gaming Technologies, Inc., Franklin, TN (US)

( * ) Notice: Subject to any disclaimer, the term of this patent is extended or adjusted under 35 U.S.C. 154(b) by 0 days.

(21) Appl. No.: 13/486,519

(22) Filed: Jun. 1, 2012

(65) Prior Publication Data

US 2013/0324218 A1 Dec. 5, 2013

(51) Int. Cl.
*G07F 17/32* (2006.01)

(52) U.S. Cl.
CPC ..... *G07F 17/3255* (2013.01); *G07F 17/323* (2013.01); *G07F 17/3244* (2013.01); *G07F 17/3258* (2013.01); *G07F 17/3267* (2013.01); *G07F 17/3269* (2013.01)

(58) Field of Classification Search
CPC . G07F 17/323; G07F 17/3244; G07F 17/3255
USPC ..... 463/25
See application file for complete search history.

(56) References Cited

U.S. PATENT DOCUMENTS 5,816,918 A * 10/1998 Kelly et al. ..... 463/16
6,146,273 A 11/2000 Olsen
6,758,755 B2 * 7/2004 Kelly et al. ..... 463/42
7,235,009 B2 6/2007 Baerlocher
7,470,190 B2 12/2008 Baerlocher et al.
7,575,517 B2 8/2009 Parham et al.
8,444,468 B2 * 5/2013 Luciano et al. ..... 463/16
8,821,292 B2 * 9/2014 Betts et al. ..... 463/42
2003/0013531 A1 * 1/2003 Rowe et al. ..... 463/42
2003/0187736 A1 * 10/2003 Teague et al. ..... 705/14
2004/0092315 A1 * 5/2004 Boyd et al. ..... 463/42
2004/0242303 A1 * 12/2004 Walker et al. ..... 463/16
2005/0026694 A1 * 2/2005 Kelly et al. ..... 463/42
2005/0130732 A1 6/2005 Rothschild et al.
2005/0131761 A1 * 6/2005 Trika et al. ..... 705/14
2005/0179201 A1 8/2005 DeSalvo, Jr.
2005/0215316 A1 * 9/2005 Rowe et al. ..... 463/29
2005/0282626 A1 * 12/2005 Manfredi et al. ..... 463/25
2006/0039733 A1 * 2/2006 Meyerhofer ..... 400/62
2006/0277100 A1 * 12/2006 Parham ..... 705/14
2007/0167210 A1 * 7/2007 Kelly et al. ..... 463/16
2007/0167226 A1 * 7/2007 Kelly et al. ..... 463/29
2007/0259709 A1 * 11/2007 Kelly et al. ..... 463/20
(Continued)

*Primary Examiner* — Dmitry Suhol
*Assistant Examiner* — David Duffy
(74) *Attorney, Agent, or Firm* — Armstrong Teasdale LLP

(57) ABSTRACT

Systems and methods for use in providing a random reward associated with at least one play-for-fun application are disclosed. One exemplary method includes crediting, at the gaming server, gaming activity directed to a play-for-fun application by a player to a player tracking account, issuing at least one coupon associated with a random reward based on at least the gaming activity credited to the player tracking account, tracking, at the gaming server, redemption of the at least one coupon, and awarding the random reward when the coupon is redeemed at a gaming machine in accordance with at least one trigger condition.

29 Claims, 3 Drawing Sheets

(56) References Cited

U.S. PATENT DOCUMENTS

| | | | | |
|---|---|---|---|---|
| 2007/0275777 | A1* | 11/2007 | Walker et al. | 463/16 |
| 2008/0009344 | A1* | 1/2008 | Graham et al. | 463/25 |
| 2008/0026822 | A1* | 1/2008 | Walker et al. | 463/25 |
| 2008/0052169 | A1* | 2/2008 | O'Shea et al. | 705/14 |
| 2009/0280891 | A1 | 11/2009 | Filipour et al. | |
| 2010/0124987 | A1 | 5/2010 | Parham | |
| 2011/0086691 | A1* | 4/2011 | Luciano et al. | 463/16 |
| 2011/0130196 | A1 | 6/2011 | Parham et al. | |
| 2011/0263325 | A1* | 10/2011 | Atkinson | 463/31 |

* cited by examiner

GAMING SYSTEMS AND METHODS FOR USE IN PROVIDING RANDOM REWARDS ASSOCIATED WITH PLAY-FOR-FUN APPLICATIONS

BACKGROUND OF THE INVENTION

The embodiments described herein relate generally to gaming systems and methods and more particularly, to providing random rewards associated with play-for-fun applications.

At least some known gaming systems provide primary games and secondary games. For example, a secondary game may be triggered by a condition, such as a particular combination of symbols associated with a primary play outcome in the primary game. A number of different secondary games are known. Secondary jackpots are generally utilized by gaming entities to encourage additional play from one or more players within a gaming establishment. An example of a secondary game is a progressive jackpot, which incrementally grows as players continue to bet at slot machines and/or video-poker machines linked to the progressive jackpot. The progressive jackpots are generally known to being geographically limited to the gaming establishment, not guaranteed to payout, and open to any player within the gaming establishment. Another example of a secondary game is a mystery jackpot. Mystery jackpots are often set up by gaming establishment, to enhance the experience of playing gaming machines, such as slot machines and/or video-poker machines, within the gaming establishment.

BRIEF DESCRIPTION OF THE INVENTION

In one aspect, a computer-implemented method for use in providing a random reward associated with at least one play-for-fun application is provided. The method includes crediting, at the gaming server, gaming activity directed to a play-for-fun application by a player to a player tracking account, issuing at least one coupon associated with a random reward based on at least the gaming activity credited to the player tracking account, tracking, at the gaming server, redemption of the at least one coupon, and awarding the random reward when the coupon is redeemed at a gaming machine in accordance with at least one trigger condition.

In another aspect, a gaming system for use in providing a random reward associated with at least one play-for-fun application is provided. The gaming system includes a gaming server configured to store a plurality of player tracking accounts, credit gaming activity directed to a play-for-fun application by a player to one of the plurality of player tracking accounts, issue at least one coupon associated with a random reward based on the gaming activity to said one of the plurality of player tracking accounts, and credit a redemption of the at least one coupon to the random reward.

In yet another aspect, one or more non-transitory computer-readable storage media having computer-executable instructions embodied thereon is provided. When executed by at least one processor, the computer-executable instructions cause the processor to credit gaming activity directed to a play-for-fun application by a player to a player tracking account, issue at least one coupon associated with a random reward based on at least the gaming activity credited to the player tracking account, tracking redemption of the at least one coupon, and award the random reward when the coupon is redeemed at a gaming machine in accordance with at least one trigger condition.

DETAILED DESCRIPTION OF THE INVENTION

Exemplary embodiments of systems and methods for use in providing a random reward are described herein. Such embodiments may enhance entertainment aspects of various play-for-fun applications by providing coupons based on gaming activity to the play-for-fun application. The coupons are redeemable for chances in random rewards games and/or jackpots in various manners, including through redemption at gaming establishments, thereby serving to enhance player traffic through the gaming establishment.

Exemplary technical effects of systems and methods described herein include at least one of: (a) crediting gaming activity directed to a play-for-fun application by a player to a player tracking account, (b) issuing at least one coupon associated with a random reward based on at least the gaming activity credited to the player tracking account, (c) tracking redemption of the at least one coupon, and (d) awarding the random reward when the coupon is redeemed at a gaming machine in accordance with at least one trigger condition.

When introducing elements of aspects of the invention or embodiments thereof, the articles "a," "an," "the," and "said" are intended to mean that there are one or more of the elements. The terms "comprising," "including," and "having" are intended to be inclusive and mean that there may be additional elements other than the listed elements.

Figure 1:
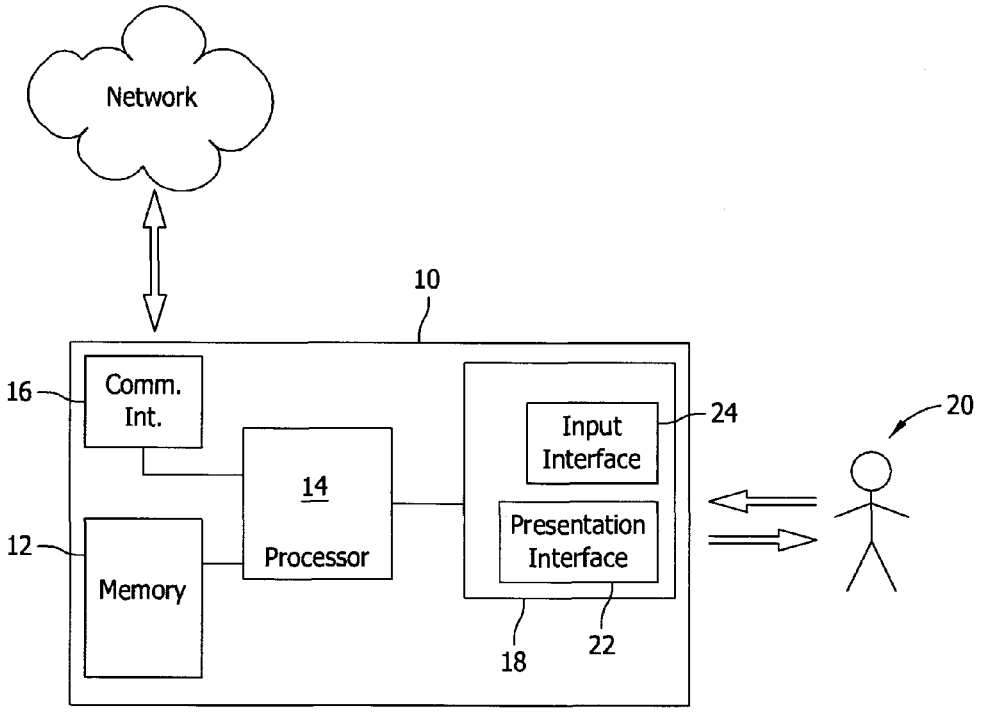
FIG. 1 is a block diagram of an exemplary computing device.

FIG. 1 illustrates an exemplary computing device 10. In the exemplary embodiment, computing device 10 includes a memory 12 and a processor 14 coupled to memory 12. In some embodiments, executable instructions are stored in memory 12 and executed by processor 14. Computing device 10 is configurable to perform one or more operations described herein by programming and/or configuring processor 14. For example, processor 14 may be programmed by encoding an operation as one or more executable instructions and providing the executable instructions in memory 12.

Memory 12 is one or more devices operable to enable information such as executable instructions and/or other data to be stored and/or retrieved. Memory 12 may include one or more computer readable media, such as, without limitation, hard disk storage, optical drive/disk storage, removable disk storage, flash memory, non-volatile memory, ROM, EEPROM, random access memory (RAM), etc. Memory 12 may be configured to store, without limitation, computer-executable instructions, player tracking accounts, credentials, play-for-fun applications, and/or any other types of data referred to herein, expressly or inherently. Memory 12 may be incorporated in and/or separate from processor 14.

Processor 14 may include one or more processing units (e.g., in a multi-core configuration). The term processor, as used herein, refers to central processing units, microprocessors, microcontrollers, reduced instruction set circuits (RISC), application specific integrated circuits (ASIC), logic circuits, and any other circuit or processor capable of executing instructions to perform functions described herein.

Computing device 10 includes a communication interface 16 coupled to processor 14. Communication interface 16 is configured to be coupled in communication with a network and/or one or more other devices, such as another computing device 10, a gaming device, a gaming machine, a gaming server, etc. Communication interface 16 may include, without limitation, a serial communication adapter, a wired network adapter, a wireless network adapter, a mobile adapter, a radio frequency (RF) receiver, a Bluetooth adapter, a Wi-Fi adapter, a ZigBee adapter, a near field communication (NFC) adapter, and/or any other device capable of communicating with one or more other devices, networks, etc.

Further, computing device 10 includes an interface 18 to interact with a user 20, such as an operator of a vehicle. Interface 18 may be configured to display information to a user 20, e.g., a player. In the exemplary embodiment, interface 18 includes a presentation interface 22, such as a cathode ray tube (CRT), a liquid crystal display (LCD), a light-emitting diode (LED) display, an organic LED (OLED) display, an "electronic ink" display, and/or other device suitable to display information. Additionally, or alternatively, interface 18 may include an audio output device (e.g., an audio adapter and/or a speaker, etc.).

Interface 18 further includes an input interface 24 configured to receive one or more inputs. Input interface 24 may include, without limitation, buttons, knobs, keypads, pointing devices, barcodes scanners, mice, cameras, card reader, touch sensitive panel (e.g., a touch pad or a touchscreen), gyroscopes, position detectors, and/or audio inputs (e.g., a microphone). For example, input interface 24 can include a coin acceptor for accepting coins and/or tokens, and a paper acceptor for accepting and/or validating cash bills or coupons from play-for-fun games. Paper acceptor or another input interface 24 may further include a card reader for use with credit cards, debit cards, identification cards, reward cards and/or smart cards. Paper acceptor may further provide a presentation interface 22, suitable for printing coupons. In various embodiments, interface 18 is a single component, such as a touchscreen display, incorporating both presentation interface 22 and input interface 24.

Figure 2:
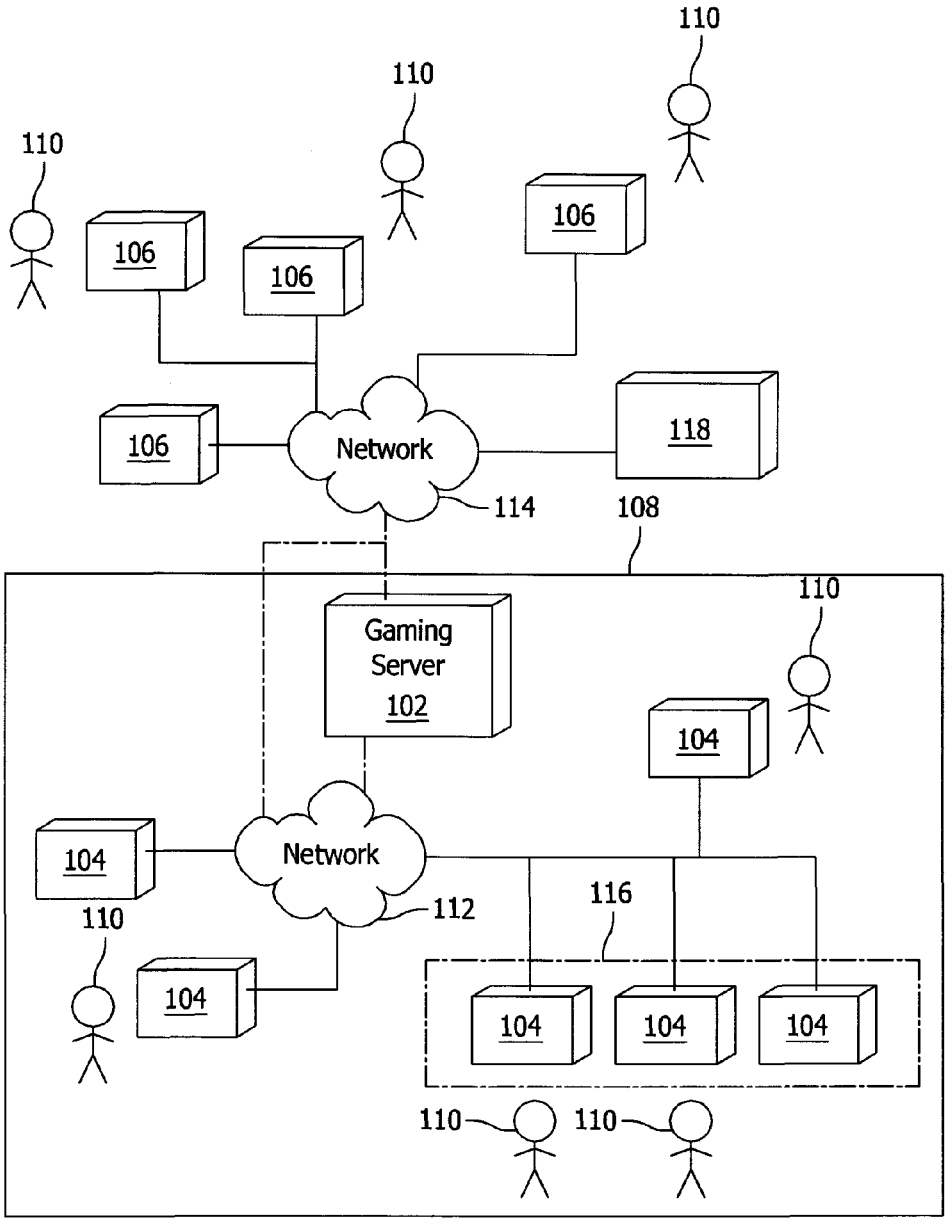
FIG. 2 is a block diagram of an exemplary gaming system, that may include multiple of the computing devices of FIG. 1.

FIG. 2 illustrates an exemplary gaming system 100. In the exemplary embodiment, gaming system 100 includes a gaming server 102, a plurality of gaming machines 104 coupled to gaming server 102, and a plurality of gaming device 106 coupled to gaming server 102. Gaming server 102, gaming machines 104, and gaming devices 106 are examples of computing devices 10. In several examples, gaming machine 104 may include, without limitation, a slot machine, a poker machine, a gaming kiosk, a bingo machine, or other machine potential employed with respect to one or more gaming activities. As shown in FIG. 2, gaming server 102 and gaming machine 104 are generally associated with (e.g., owned, operated, and/or managed by) a gaming establishment 108 to enable gaming activities by one or more players 110 present within the gaming establishment. Gaming establishment 108 may include, for example, a casino. In various embodiments, gaming server 102 may be physically located inside or outside of gaming establishment 108, yet still associated therewith.

Moreover, in the exemplary embodiment, gaming server 102 is illustrated as a single computing device, located within gaming establishment. Gaming server 102 may include different computing devices located together or separated over a geographic region in other gaming system embodiments.

In some examples, gaming device 106 may include a portable communication device, such as a smartphone, a laptop, a tablet, a personal digital assistant (PDA), a portable gaming console, or other portable computing device suitable for use as described herein. In other examples, gaming device 106 may include, without limitation, a personal computer, a gaming console, a workstation, or other non-portable computing device. As shown in FIG. 2, gaming device 106 are generally associated with (e.g., owned, operated, and/or managed by) player 110, rather than the gaming establishment.

Gaming server 102 is coupled to gaming machines 104 through a first network 112. In several embodiments, first network 112 is a private network, substantially controlled by an operator of gaming establishment 108. In other embodiments, first network 112 can include a partially or wholly public network. Further, in the exemplary embodiment, gaming server 102 is coupled to gaming device 106 through a second network 114. In the exemplary embodiment, second network 114 includes a public network, accessible to various different types of device, generally outside the control of the operator of gaming establishment 108. In another embodiment, second network 114 may include a private network, such as a gaming network, to access, for example, one or more play-for-fun applications. First and second networks 112 and 114 may include, without limitation, the Internet, a local area network (LAN), a wide area network (WAN), a wireless LAN (WLAN), a mesh network, a virtual private network (VPN), a cellular network, and/or any other network that gaming system 100 to function as described herein.

In the exemplary embodiment, gaming sever 102 manages one or more aspects, games, jackpots, player accounts, and/or other operations of gaming establishment 108. For example, gaming server 102 is provided to manage one or more random rewards. As used herein, the term "random reward" refers to a secondary game hosted by a gaming entity, at gaming server 102, which pays an award, once at least one predetermined condition is satisfied. A random reward may include, for example, a mystery jackpot, which is guaranteed to pay, when one of the plurality of gaming machines 104 pushing a running total associated with the mystery jackpot over a trigger amount, i.e., a trigger condition. Trigger conditions are generally tracked by gaming server 102 and may include, without limitation, number of coupons redeemed, time intervals, particular gaming machines, etc.

In the exemplary embodiment, a random reward may also include, but is not limited to only including, a random bonus, or any other award that can be based on any number of factors, including random coin-in determination, a predetermined time, a random gaming machine, a random casino, a random player tracking number, and/or any combination of such factors. In one embodiment, the random reward payment may include bonus feature rounds, win multipliers, or free-spins for the player who triggers the random reward and/or all players associated with the random reward, including a "circle of friends". As used herein, the term "circle of friends" refers to a smaller group of individuals that have a relationship, wherein all requested to participate in the circle. In such a relationship, generally one player oversees the circle and sends out invitations to form the circle. Such a relationship may be based on any number of factors including a preferred gaming location of the players, the age of the players, the geographic location of the players, and/or any combination of these factors and others. As such, participants in the circle of friends may be at multiple locations, may not participate through traditional casinos, and/or may use multiple devices, including those that participate remotely through the Internet, for example. In another example, participants in the circle of friends could participate through a social media account, such as through Facebook®, for example. It should be noted, that as used herein, the right to participate in the circle of friends is provided to a person and not to a specific device. In at least one embodiment, the random reward payout may be multiplied by the player's bet when the player triggered the random reward. Additionally, or alternatively, the random reward payout may be determined by the rewards account of the player triggering the random reward, and/or the rewards accounts of some or all players associated with the random reward. The random reward payout may be determined and/or modified, by gaming server 102, when the random reward is established, when the random reward is triggered, and/or at some point therebetween.

Gaming server 102 is provided to detect inputs related to the random rewards, and ultimately, award the random reward when the at least one trigger condition is satisfied. In the exemplary embodiment, the random rewards may be secondary games to play-for-fun applications at gaming devices 106 and/or primary games at gaming machines 104. Gaming server 102 may perform a plurality of functions including, for example, game outcome generation, and/or accounting functions. However, in alternative embodiments, gaming system 100 may include a plurality of servers that separately perform these functions and/or any suitable function for use in a network-based gaming system. In some embodiments, gaming server 102 controls bonus applications or bonus systems that award bonus (e.g., base play bonuses and/or free plays) opportunities on gaming system 300. Moreover, gaming server 102 may include a set of rules for awarding jackpots in excess of those established by winning pay tables (not shown) of each gaming machine 100. Some bonus awards may be awarded randomly, while other bonus awards may be made to groups of gaming machines 100 operating in a progressive jackpot mode.

Additionally, gaming server 102 manages a plurality of player tracking accounts. Each of the player tracking accounts is associated with a player 110 to track various aspects of the player's interactions within gaming system 100. For example, gaming server 102 keeps track of player information including, without limitation, player contact information, time spent playing particular games, favorite types of gaming machines 104, player bet data, preferred hours of gaming, preferred applications, preferred table games, and/or any other information about the player or the player's interaction with gaming system 100. Operators of gaming establishment 108 may utilize such information to provide specials, incentives, and/or rewards to player 110 based on one or more aspects of the information. In various embodiments, players 110 receive and retain player's cards, which permit gaming machines 104 and/or other games to associate player 110 with a particular player tracking account. For example, a player's card may include an account number associated with the player tracking account, which is electronically readable by a card reader input interface 24, at a gaming machine 104.

In the exemplary embodiment, gaming device 106 is further provided play-for-fun applications to player 110. As used herein, the term "play-for-fun" application refers to applications, which do not provide the opportunity, within the application, to wager and/or win real money. Play-for-fun applications may, however, be utilized to provide opportunities to wager and/or win real money separate from the application, yet within gaming system 100. Play-for-fun applications may include, without limitation, poker games, racing games, sports games, or other games, which may be played at gaming device 106. When a play-for-fun application is played at gaming device 106, gaming activity is accumulated by player 110 for the play-for-fun application. Gaming activity may be measured, for example, based on time played, level, object, and/or points achieved, games played, and/or other metrics associated with the play-for-fun application.

Methods and systems are provided herein to provide a random reward associated with at least one play-for-fun application. In the exemplary embodiment, the play-for-fun application is linked to a player tracking account, such that gaming activity to the play-for-fun application, at gaming device 106, may be credited to the player tracking account maintained at gaming server 102. The gaming activity from a play-for-fun application may be utilized in various manners to provide coupons, which may be redeemed by player 110 for chances to win the random reward. It should be appreciated that various different permutation of participating in one or more random rewards may be derived from gaming activity to a play-for-fun application. In various embodiments, the gaming activity may provide one or more coupons to player 110, for example, which may be redeemable within gaming establishment 108. In this manner, methods and systems herein may utilize a play-for-fun application to enhance traffic into gaming establishment 108, while enhancing the entertainment value of the play-for-fun application.

As used herein, server 102 issues at least one coupon that can include at least one barcode printed thereon. For example, in at least some embodiments, the coupon can include a plurality of different barcodes wherein at least two different authorities with their own certificates are associated with different barcodes on the same coupon. Such a coupon may be deemed a "divisible coupon" wherein the coupon may be split into multiple pieces within the group associated with the player earning the coupon. For example, in one embodiment, each active participant in the circle of friends associated with the player earning the coupon receives a piece of the coupon issued by server 102. Moreover, in such an embodiment, each active participant in the circle of friends may receive an additional benefit triggered when a predefined percentage of participants redeem or cash-in their coupons within a predefined time period.

Figure 3:
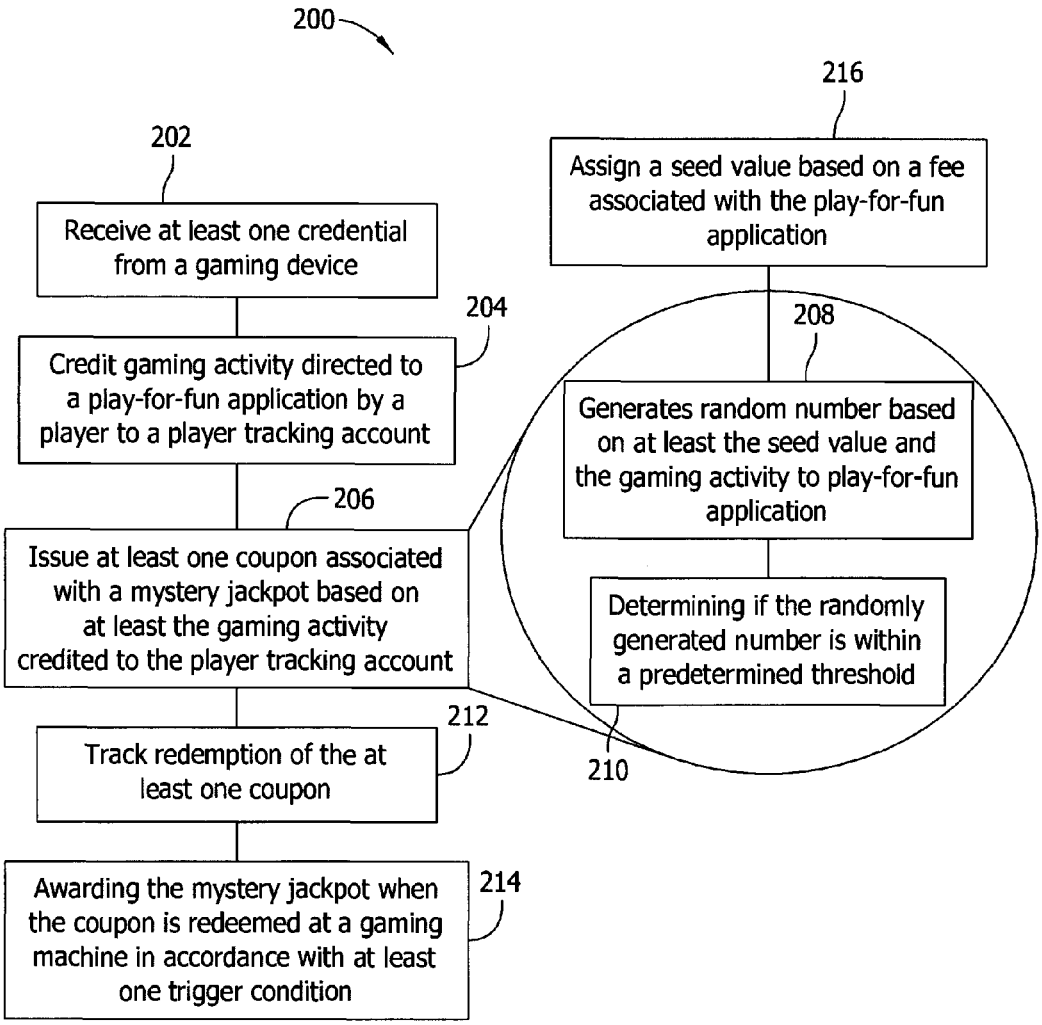
FIG. 3 is a block diagram of the exemplary methods for use in providing a random reward associated with at least one play-for-fun application.

FIG. 3 illustrates an exemplary method 200 for use in providing a random reward associated with at least one play-for-fun application. While method 200 is described herein with reference to gaming system 100, it should be appreciated that method 200 should not be understood to be limited to gaming system 100 and that method 200 may be used in other gaming system embodiments. Moreover, gaming system 100 should not be understood to be limited to method 200.

In the exemplary embodiment, gaming server 102 receives 202 at least one credential from gaming device 106. The credential permits gaming server 102 to identify gaming activity and/or other information provided from gaming device 106 as related to the particular player 110 and/or a player tracking account. The credential may include, for example, a username, a password, a player tracking account number, a redemption code, and/or other information identifying of player 110 and/or a player tracking account. In several embodiments, gaming device 106 receives the credential from player 110, prior to transmitting the credential to gaming server 102. Gaming device 106 may receive, for example, the credential from player 110 when the play-for-fun application is initialized. In at least one embodiment, gaming device 106 and/or the play-for-fun application requires the credential to initiate the play-for-fun application. Additionally, or alternatively, the play-for-fun application can be registered with gaming server 102, such that each time the play-for-fun application is initialized, gaming device 106 automatically transmits the credential to gaming server 102. It should be appreciated that one or more credentials may be provided, entered, and/or generated through use of gaming device 106 to indicate to gaming server 102 the player tracking account associated with the play-for-fun application.

When the play-for-fun application is initialized, and gaming server 102 has received the credential, the player is permitted to play the play-for-fun application. In turn, gaming server 102 tracks the gaming activity through the link between the play-for-fun application and the player tracking account and credits 204 the gaming activity directed to a play-for-fun application by a player to the player tracking account.

In the exemplary embodiment, gaming server 102 proceeds to issue 206 at least one coupon associated with a random reward based on at least the gaming activity credited to the player tracking account. In the exemplary embodiment, server 102 issues 206 at least one coupon that can include at least one barcode printed thereon. For example, in at least some embodiments, the coupon can include a plurality of different barcodes wherein at least two different authorities with their own certificates are associated with different barcodes on the same coupon. In several examples, gaming server 102 is able to use gaming activity in a variety of different ways to determined when to issue coupons for the random reward coupon. In one example, gaming server 102 may include a random number generator, which operates based on a seed value. In such an example, gaming server 102 generates 208 random number based on at least the seed value and the gaming activity to play-for-fun application. More specifically, in some examples, gaming server 102 generates 208 a random number for gaming activity, based on an interval of time, a level/object achieved in the play-for-fun application, a number of games played, or other metric associated with the gaming activity. Subsequently, gaming server 102 determines 210 if the randomly generated number is within a trigger threshold. When the randomly generated number is within the trigger threshold, gaming server 102 issues 206 a random reward coupon. As used herein, the random number generator may include true random number generator or a pseudo-random number generator, implemented in software, hardware, and/or firmware. In various examples, the random number generator is implemented in processor 14 of gaming server 102.

In alternative examples, gaming server 102 may issue random reward coupons based on trigger thresholds, without the use of a random number generator. In such an example, gaming server 102 issues the coupon for the random reward whenever a player achieves a new level in the play-for-fun application. In another example, gaming server 102 can issue a random reward coupon when the gaming activity reaches a predetermined interval, such as, for example, about 18 hours, about 30 hours, or about 50 hours. It should be appreciated that gaming server 102 can use one or more measures of gaming activity, alone or in combination with a random number generator, in a variety of ways to determined when one or more random reward coupons should be issued. For example, in one embodiment, before a player can qualify to be rewarded a coupon, gaming server 102 must determine that a plurality of players are playing individually or via a linked connection, such as a circle of friends, before at least one of those players is eligible to be rewarded a coupon. The variety of different ways may further be altered and/or adjusted for various reasons to increase or decrease the odds of issuing a random reward coupon. In at least one example, the type of player 110 associated with a player tracking account may also affect the issuance of random reward coupons. In such an example, a gold player may receive more coupons, than a silver player for the same gaming activity.

Further, in at least one example, the random rewards coupon may further be issued as a divisible coupon, such that multiple players are able to redeem the divided portions of the coupon. In this manner, additional players may be associated with the random rewards coupon, thereby incentivizing player traffic through a gaming establishment. The coupon may be physically divisible by a player for dissemination to other players, and/or provided to the player electronically, such that the player is able to designate one or more person to receive the divided coupon. In another example, the coupon may be issued directly, in electronic form (e.g., SMS message email message, etc.) or in paper form (e.g., mail, etc.), to one or more other players based on information included in a player tracking account associated with the player.

In the exemplary embodiment, the random reward coupon is issued electronically to player 110, through gaming device 106. The coupon may issue, for example, to player 110 through the player tracking account, such that the player is able to retrieve the coupon at gaming machine 104, such as a kiosk, within gaming establishment 108. In other examples, gaming server 102 may transmit the coupon to player 110, via email, SMS message, phone message, postal mail, or other suitable manner of transmitting a coupon. In at least one embodiment, the coupon is printed for the player at presentation device 22 (e.g., a printer) included in and/or associated with gaming device 106. Accordingly, coupons may be issues in printed form, electronic form, and/or virtual form to a player. As such, the coupon for the random reward may include, for example, a form, a paper letter, a ticket, a voucher, a certificate, and/or an alpha/numeric code, etc. In several embodiments, the manner in which the coupon is delivered and/or transmitted to player 110 may be based on the type of coupon.

After one or more coupons are issued, player 110 proceeds to redeem the random reward coupons at gaming establishment 108. For example, player 110 presents the coupon for redemption at one or more of gaming machines 104. In one example, gaming machine 104 is a kiosk, located within gaming establishment 108. In another example, gaming machine 104 is a poker machine. In at least one embodiment, select ones 116 of gaming machines 104 may be dedicated for redemption of coupons for the random reward. Player 110 can redeem a paper coupon through insertion into a paper acceptor input interface 24 of gaming machine 104. Alternatively, player 110 can redeem a code-type coupon by entering the code into one or more gaming machine 104. It should be understood that player 110 may be able to redeem more than one coupon for the random reward at one time. Moreover, as each coupon is issued, in one embodiment, a copy of the barcode image, i.e., a jpeg image, is stored in a database within memory 12.

As coupons are redeemed by one or more players, gaming server 102 tracks 212 redemption of the coupons through gaming machines 104. In the exemplary embodiment, tracking 212 the redemption of the coupons includes crediting the random reward with the redeemed coupons and determining if the coupon is redeemed in accordance with one or more trigger conditions. In various examples, trigger conditions may include a predetermined number of coupons redeemed or redemption of coupons within a particular time interval. In one example, a particular time interval may be selected to coincide with a traditional slow time of day, such as, for example, between 1:00 pm and 3:00 pm. In other examples, a random number generator may be used to generator random number each time a coupon is redeemed, where a trigger condition is satisfied when the randomly generated number exceeds a predetermined threshold. In still other example, redemption of all divided portions of a coupon may be a trigger condition. As should be appreciated, one or more different trigger conditions may be provided, based on a variety of information regarding players 110 redeeming coupons, the play-for-fun application, or other aspects selected based on or by players 110 and/or the gaming establishment 108.

Further, in embodiment in which a coupon is divided, gaming server 102 may require redemption of a predetermined number and/or all of the divided portions of the coupon in order to recognize the coupon as redeemed. Further, depending on the division of the coupon, one or more different portions may be tracked by gaming server 102 to potentially trigger one or more trigger conditions. For example, gaming server 102 may track all divided portions of a coupon, and only credit the random reward with the redeemed coupon when the entire coupon (e.g., all divided portions) has been redeemed. In other example, gaming server 102 may require less than all of the divided portions of the coupon to be redeemed in order to credit the random reward. In at least one example, the random reward is credited with the redemption of the coupon, when the player 110 causing the coupon to issue 206 through gaming activity to the play-for-fun application redeems his/her divided portion of the coupon. In such an example, only players 110 which have already redeemed their divided portion of the coupon may be eligible for the random reward.

In the exemplary embodiment, gaming server 102 awards 214 the random reward to the player when the coupon is redeemed in accordance with at least one trigger condition. When the coupon was undivided, the random reward is generally awarded to the player redeeming the coupon. If, however, the coupon had been divided, the random regard may be delivered to the player triggering the random reward, all players having a divided portion of the coupon triggering the random reward, and only person who had redeemed their divided portion of the coupon when the random reward was triggered. Furthermore, in addition to the random reward, additional rewards may be awarded to players redeeming coupons, or divided portions of coupons. For example, even when a random reward is not trigger, coupons redemption may provide player 110 with free spins, bonuses, or other rewards, aside from the random reward. In this manner, gaming activity to gaming machines 104 may be enhanced when players 110 redeem coupons, issued based on gaming activities to play-for-fun applications.

In various embodiments, the play-for-fun application is available to be downloaded from gaming server 102. In at least one embodiment, gaming server 102 operates a website for players 110 to access through network 114. The website may enable the player to select from a listing of play-for-fun applications. In response to a request from the gaming device, gaming server 102 transmits a selected one of the play-for-fun applications to gaming device 106 for installation and/or initialization. By providing the play-for-fun applications from gaming server 102, gaming sever 102 is able to track the play-for-fun applications and automatically link to the play-for-fun applications to player tracking accounts during downloading of the play-for-fun application. In this manner, player 110 separately downloading the play-for-fun application and associating the play-for-fun application with a player tracking account may be avoided.

Additionally, or alternatively, the play-for-fun application may be downloaded from a third-party server 118. Third-party server 118 may be, for example, an entity in the business of providing and/or selling applications for download to gaming devices 106. When downloaded from third-party server 118, the player may be required to register the play-for-fun application with the gaming server 102, and/or otherwise prompt gaming server 102 to associate the play-for-fun application with a player tracking account.

It should be appreciated that play-for-fun application may be provided from gaming server 102 and/or third-party server 118 free or for a fee. In several embodiments, paying a fee for the play-for-fun application may affect how coupons for the random reward are issued, the type of random rewards available, or other aspects of the above method. In one example, as shown in FIG. 3, gaming server 102 assigns 216 a seed value based on a fee associated with the play-for-fun application. In such an example, a play-for-fun application with a seed value causing more frequent coupons may cost more than a play-for-fun application with a seed value causing less frequent coupons. In various other embodiments, a seed value may be assigned by gaming server 102 based on a rating or type of player associated with the player tracking account. For example, a play-for-fun application used by a platinum member may more frequently issue coupons, than the same play-for-fun application used by a silver member.

The systems and methods are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems and/or methods and are not limited to practice with only the systems, methods, and storage media as described herein.

By way of example and not limitation, computer readable media includes, for example, a non-transitory computer storage device. Computer storage media include volatile and nonvolatile, removable and non-removable media implemented in any method or technology for storage of information such as computer readable instructions, data structures, program modules, or other data in a device.

Although the present disclosure is described in connection with an exemplary gaming system, embodiments of the invention are operational with numerous other general purpose or special purpose gaming systems or configurations. The gaming system is not intended to suggest any limitation as to the scope of use or functionality of any aspect described herein. Moreover, the gaming system environment should not be interpreted as having any dependency or requirement relating to any one or combination of components illustrated in the exemplary operating environment.

Embodiments of the invention may be described in the general context of computer-executable instructions, such as program components or modules, executed by one or more computers or other devices. Aspects described herein may be implemented with any number and organization of components or modules. For example, aspects of the invention are not limited to the specific computer-executable instructions or the specific components or modules illustrated in the figures and described herein. Alternative embodiments of the invention may include different computer-executable instructions or components having more or less functionality than illustrated and described herein.

The order of execution or performance of the operations in the embodiments illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A computer-implemented method for use in providing random rewards associated with a play-for-fun application, said method implemented by:

a gaming machine including a display device, an accepting device configured to accept a physical item associated with a monetary value, the monetary value associated with a player tracking account, said method comprising:

crediting, at a gaming server communicatively coupled to the gaming machine as part of a computing network and associated with a gaming establishment, gaming activity directed to the play-for-fun application by a player to the player tracking account, wherein the play-for-fun application does not provide the opportunity to wager or win money within the play-for-fun application, and wherein the gaming activity occurs outside of the gaming establishment;

assigning at least one divisible coupon to the player tracking account, the at least one divisible coupon divided by the player into a plurality of coupon portions and associated with a random reward based on at least the gaming activity, wherein the player tracking account is configured to track redemption of the plurality of coupon portions, wherein each player of a group of players including the player can redeem at least one of the plurality of coupon portions, wherein the at least one divisible coupon is issued to the player, and wherein the random reward is associated with one or more of a payout and a secondary game application;

based on a trigger condition satisfied at the gaming machine at the gaming establishment, applying, by the gaming server, at the gaming machine, the at least one divisible coupon, wherein the trigger condition includes redemption, via the accepting device, of a predefined subset of the plurality of coupon portions;

electronically activating the random reward, wherein awarding the random reward when the at least one divisible coupon is redeemed under the trigger condition includes awarding the random reward when the at least one divisible coupon is redeemed after a predetermined number of coupons have been redeemed; and causing the gaming machine to display, on the display device, the random reward, including displaying one or more of the payout and the secondary game application.

2. The method of claim 1, wherein assigning the at least one divisible coupon based on at least the gaming activity credited to the player tracking account includes:

generating, at the gaming server, a substantially random number based on a seed value and the gaming activity credited to the player tracking account; and assigning the at least one divisible coupon when the substantially random number satisfies a predetermined condition.

3. The method of claim 2, further comprising assigning the seed value based on a fee associated with the play-for-fun application.

4. The method of claim 1, wherein assigning the at least one divisible coupon based on at least the gaming activity credited to the player tracking account includes assigning the at least one divisible coupon when the gaming activity satisfies at least one predetermined condition.

5. The method of claim 1, further comprising:

transmitting the play-for-fun application to a computing device in response to a request from the player;

receiving at least one credential from the player; and associating the play-for-fun application with the player tracking account based on the at least one credential.

6. The method of claim 1, further comprising electronically transmitting the at least one divisible coupon to the player based on contact information associated with the player tracking account.

7. The method of claim 1, further comprising providing a status, for presentation to the player, indicating at least one of a proximity of gaming activity relative to a next coupon assignment and a proximity of the random reward to satisfying the at least one trigger condition.

8. The method of claim 1, wherein awarding the random reward when the at least one divisible coupon is redeemed under at least one trigger condition includes awarding the random reward when the at least one divisible coupon is redeemed during a predetermined interval.

9. The method of claim 1, wherein the play-for-fun application includes at least one of a card game, a slot game, a racing game, and a puzzle game.

10. The method of claim 1, wherein the at least one divisible coupon assigned includes at least one barcode image corresponding to the random reward.

11. The method of claim 1, wherein the player is one of a plurality of participants associated by a predefined relationship.

12. The method of claim 1, further comprising, upon issuing the at least one divisible coupon associated with a random reward based on at least the gaming activity credited to the player tracking account, sending the at least one divisible coupon to each player in a predefined group of players that are associated with the player.

13. A gaming system for use in providing random rewards associated with a play-for-fun application, said gaming system comprising:

a gaming machine comprising a display device, an accepting device configured to accept a physical item associated with a monetary value, the monetary value associated with a player tracking account; and a gaming server electronically coupled to the gaming machine and configured to:

store a plurality of player tracking accounts;

credit gaming activity directed to the play-for-fun application by a player to one of the plurality of player tracking accounts, wherein the play-for-fun application does not provide the opportunity to wager or win money within the play-for-fun application;

assign at least one divisible coupon to the player tracking account, the at least one divisible coupon divided by the player into a plurality of coupon portions and associated with a random reward based on the gaming activity, wherein the player tracking account is configured to track redemption of the plurality of coupon portions, wherein each player of a group of players including the player can redeem at least one of the plurality of coupon portions, wherein the at least one divisible coupon is issued to the player, and wherein the random reward is associated with one or more of a payout and a secondary game application, and wherein the gaming activity occurs outside of a gaming establishment associated with the gaming server; and based on a trigger condition satisfied at the gaming machine at the gaming establishment, apply, by the gaming server, at the gaming machine, the at least one divisible coupon, wherein the trigger condition includes redemption, via the accepting device, of a predefined subset of the plurality of coupon portions;

electronically activate the random reward, wherein awarding the random reward when the at least one divisible coupon is redeemed under the trigger condition includes awarding the random reward when the at least one divisible coupon is redeemed after a predetermined number of coupons have been redeemed; and cause the gaming machine to display, on the display device, the random reward, including displaying one or more of the payout and the secondary game application.

14. The gaming server of claim 13, wherein said gaming server is configured to assign the at least one divisible coupon when the gaming activity satisfies at least one predetermined condition.

15. The gaming server of claim 13, further comprising a gaming machine coupled to said gaming server, said gaming machine configured to receive the at least one divisible coupon, at an input device, and indicate receipt of the at least one divisible coupon to said gaming server, wherein said gaming server is configured to receive the indication from the gaming machine and credit the redemption of the at least one divisible coupon for the random reward based on the indication from the gaming machine.

16. The gaming server of claim 13, wherein said gaming server is configured to generate a substantially random number based on a seed value and the gaming activity credited to at least one of the plurality of player tracking accounts and assigning the at least one divisible coupon when the substantially random number satisfies a predetermined condition.

17. The gaming server of claim 16, wherein the seed value is based at least partially on a fee associated with the play-for-fun application.

18. The gaming server of claim 13, wherein said gaming server is configured to provide for presentation to the player a listing of play-for-fun applications and transmit a selected play-for-fun application from the listing of play-for-fun applications.

19. The gaming server of claim 13, wherein said gaming server is further configured to generate at least one divisible coupon including at least one barcode image thereon.

20. The gaming server of claim 13 wherein said gaming server is further configured to assign the at least one divisible coupon to at least two players satisfying a predetermined relationship.

21. One or more non-transitory computer-readable storage media having computer-executable instructions embodied thereon, the instructions executed by a gaming server including a processor and a database that is communicatively coupled to a gaming machine including a display device, an accepting device configured to accept an item associated with a monetary value, the monetary value associated with a player tracking account, wherein when executed by at least one processor, said computer-executable instructions cause the processor to:

credit gaming activity directed to a play-for-fun application by a player to a player tracking account, wherein the play-for-fun application does not provide the opportunity to wager or win money within the play-for-fun application, and wherein the gaming activity occurs outside of a gaming establishment;

assign at least one divisible coupon to the player tracking account, the at least one divisible coupon divisible into a plurality of coupon portions and associated with a random reward based on at least the gaming activity credited to the player tracking account for the gaming activity directed to the play-for-fun application, wherein the player tracking account is configured to track redemption of the plurality of coupon portions, wherein each player of a group of players including the player can redeem at least one of the plurality of coupon portions, wherein the at least one divisible coupon is issued to the player, and wherein the random reward is associated with one or more of a payout and a secondary game application;

based on a trigger condition satisfied at the gaming machine at the gaming establishment, apply, by the gaming server, at the gaming machine, the at least one divisible coupon, wherein the trigger condition includes redemption, via the accepting device, of a predefined subset of the plurality of coupon portions;

electronically activate the random reward, wherein awarding the random reward when the at least one divisible coupon is redeemed under the trigger condition includes awarding the random reward when the at least one divisible coupon is redeemed after a predetermined number of coupons have been redeemed; and cause the gaming machine to display, on the display device, the random reward, including displaying one or more of the payout and the secondary game application.

22. The non-transitory computer-readable storage media of claim 21, wherein said computer-executable instructions further cause the processor to randomly generate a random number based on a seed value and the gaming activity, and assign the at least one divisible coupon associated with a random reward based on the randomly generated number.

23. The non-transitory computer-readable storage media of claim 21, wherein said computer-executable instructions further cause the processor to receive at least one player credential and credit gaming activity directed to the play-for-fun application by a player to a player tracking account based on the at least one player credential.

24. A gaming device for use in providing random rewards associated with a play-for-fun application, said gaming device in communication with a gaming machine comprising a display device, an accepting device configured to accept a physical item associated with a monetary value, said gaming device configured to:

credit gaming activity directed to the play-for-fun application by a player to the player tracking account, wherein the play-for-fun application does not provide the opportunity to wager or win money within the play-for-fun application;

assign at least one divisible coupon to the player tracking account, the at least one divisible coupon divided by the player into a plurality of coupon portions and associated with a random reward based on at least the gaming activity credited to the player tracking account for the gaming activity directed to the play-for-fun application, wherein the player tracking account is configured to track redemption of the plurality of coupon portions, wherein each player of a group of players including the player can redeem at least one of the plurality of coupon portions, wherein the at least one divisible coupon is issued to the player, and wherein the random reward is associated with one or more of the payout and a secondary game application;

apply, based on a trigger condition at the gaming machine, the at least one divisible coupon to the player tracking account, wherein the trigger condition includes redemption, via the accepting device, of a predefined subset of the plurality of coupon portions; and electronically activate the random reward, wherein awarding the random reward when the at least one divisible coupon is redeemed under the trigger condition includes awarding the random reward when the at least one divisible coupon is redeemed after a predetermined number of coupons have been redeemed; and cause the gaming machine to display, on the display device, the random reward, including displaying one or more of the payout and the secondary game application.

25. The gaming device of claim 24, wherein assigning the at least one divisible coupon based on at least the gaming activity credited to the player tracking account includes:

generating, at the gaming device, a substantially random number based on a seed value and the gaming activity credited to the player tracking account; and assigning the at least one divisible coupon when the substantially random number satisfies a predetermined condition.

26. The gaming device of claim 24, wherein assigning the at least one divisible coupon based on at least the gaming activity credited to the player tracking account includes assigning the at least one divisible coupon when the gaming activity satisfies at least one predetermined condition.

27. The gaming device of claim 24, wherein the player is one of a plurality of participants associated by a predefined relationship.

28. The gaming device of claim 24, wherein the gaming device is further configured to provide a status, for presentation to the player, indicating at least one of a proximity of gaming activity relative to a next coupon assignment and a proximity of the random reward to satisfying the at least one trigger condition.

29. The gaming device of claim 24, wherein awarding the random reward when the divisible coupon is applied further includes one or more of:

awarding the random reward when the at least one divisible coupon is redeemed during a predetermined interval.

* * * * *